United States Patent [19]

Hempy et al.

[11] Patent Number: 4,934,422

[45] Date of Patent: Jun. 19, 1990

[54] BENCH MOUNTABLE PLATE JOINING MACHINE

[75] Inventors: Robert M. Hempy; Charles J. Baird, both of Pittsburgh; Jeffrey L. Haffely, Gibsonia, all of Pa.

[73] Assignee: Delta International Machinery Corp., Pittsburgh, Pa.

[21] Appl. No.: 423,219

[22] Filed: Oct. 18, 1989

Related U.S. Application Data

[63] Continuation of Ser. No. 233,492, Aug. 19, 1988, abandoned.

[51] Int. Cl.[5] ..... B27C 5/00

[52] U.S. Cl. ..... 144/136 R; 33/570; 144/136 C; 144/371; 269/189; 269/297; 269/303; 409/178; 409/182

[58] Field of Search ..... 409/178, 182; 269/290, 269/291, 297, 303, 304, 309, 172; 83/435.1, 438, 448, 439; 33/568, 569, 570, 573; 144/134 R, 134 D, 136 R, 136 C, 84, 85, 86, 87

[56] References Cited

U.S. PATENT DOCUMENTS

| | | | |
|---|---|---|---|
| 1,687,207 | 10/1928 | Hawker . | |
| 1,981,183 | 11/1934 | Margelis . | |
| 2,378,713 | 6/1945 | Lawton . | |
| 2,610,658 | 9/1952 | Koeling . | |
| 2,952,281 | 9/1960 | Weber . | |
| 3,282,308 | 11/1966 | Sprague . | |
| 3,812,584 | 5/1974 | Peter . | |
| 4,062,390 | 12/1977 | Beekenkamp . | |
| 4,259,887 | 4/1981 | Dean . | |
| 4,434,586 | 3/1984 | Muller et al. . | |
| 4,545,121 | 10/1985 | Ambruster et al. . | |
| 4,615,654 | 10/1986 | Shaw | 144/136 C |
| 4,749,013 | 6/1988 | Ducate, Sr. | 144/84 |

FOREIGN PATENT DOCUMENTS

| | | | |
|---|---|---|---|
| 2838233 | 6/1979 | Fed. Rep. of Germany | 144/136 C |
| 337653 | 5/1959 | Switzerland . | |
| 339753 | 8/1959 | Switzerland . | |

OTHER PUBLICATIONS

*Furniture Design & Manufacturing,* Mar., 1984, p. 16, by Glen O. Fuglsby, Ph.D., entitled "Wood Technology--Plate Joinery System".

*Northern Woods,* (Newletter), Issue No. 12, Spring Quarter, 1988, p. 1, article entitled "Plate Joinery", by Annette Weir.

*Workbench,* Apr., 1988, p. 1, entitled "The Workbench Guide to Plate Joiners", by Lawrence Okrend.

*Popular Woodworking,* Jun./Jul., 1987, p. 23, entitled "Is There a Plate Joiner in Your Future?", by Hugh Foster.

*Wood Magazine,* Jun., 1988, p. 44, by Jim Barrett, "Make Strong, Accurate Joints in Seconds with Plate Joiners".

Lamello-Minilo brochure, date unknown, entitled "Hardly Believable, It's So Easy, and the Job is Finished So Quickly".

Elu brochure, date unknown, entitled "Another First From Elu. 'Biscuit' Jointer and Groover. DS140".

Virutex brochure, date unknown, entitled "Ensambladora 0=87".

Lamello brochure, date unknown, "Nutfrasmaschine Mit Schwenkbarem Anschlag Fur Top-Verbindungen . . . damit die Arbeit Spass macht".

Lamelo 2000 (Steiner Lamello SA) brochure, date unknown, "Universal Circular Saw and Grooving Machine; Lamello Automate Wood Joining for Mass Production".

Lamello Top brochure, date unknown, "Groove Cutting Machine with Swivelling Stop for Top Connections . . . That Make Work a Pleasure".

Minilo Top Brochure, date unknown, entitled "For Top Joints . . . That Make Work a Pleasure".

*Primary Examiner*—W. Donald Bray

*Attorney, Agent, or Firm*—Merchant, Gould, Smith, Edell, Welter & Schmidt

[57] ABSTRACT

Disclosed is a bench mountable joining machine. The joining machine comprises machine apparatus for supporting and positioning a workpiece while making a slot-like plunge cut into a joint surface of the workpiece. The machine also includes a base member for removably mounting the machine to a bench.

31 Claims, 3 Drawing Sheets

BENCH MOUNTABLE PLATE JOINING MACHINE

This is a continuation, of application Ser. No. 07/233,492 filed Aug. 19, 1988, now abandoned.

FIELD OF THE INVENTION

The present invention relates generally to the field of woodworking and more specifically to a benchmountable machine used in plate joinery which provides precision support and alignment for workpieces to receive a plunge cut or kerf in joint surfaces.

BACKGROUND OF THE INVENTION

Plate joinery permits accurate and secure attachment of workpieces connected at a joint. Typical plate joinery requires a device for making a plunge cut or kerf in a joint surface designed for receipt of a plate (also called a biscuit, wafer, or spline) of compressed wood or other material. Oppositely disposed grooves are cut into each piece of wood to be joined. Then glue and a plate is placed within each groove, and the plates are allowed to expand from application of the glue. The expansion of the glued biscuit in the opposing cuts provides an accurate, strong woodworking joint. Accordingly, plate joinery provides a strong, simple, and relatively long-lasting joint for use in the field of woodworking.

Hand held plate joiner devices are generally comprised of a handle, a motor unit and a rotating cutter. A portion of the housing contacts a joint surface, and the rotating cutter is then operably moved toward and engages a portion of the joint surface at the location of the desired cut. The rotating cutter then cuts into the joint surface and is retracted. Particular advantages of plate joinery over other joint-forming methods includes the aesthetic result and overall efficiency.

However, proper plate joinery requires precision cuts of predetermined depth and location in the corresponding workpieces. Improper placement of a blade section of a plate joining machine with respect to a workpiece surface may result in misalignment between cuts in opposing workpieces and in improper orientation of the cut with respect to the joint surfaces, resulting in misaligned workpiece and/or joint surfaces. For example, substantial misalignment may occur between workpieces which have only minor differences in thickness, or open joints may occur. Most prior art portable plate joiners are capable of referencing the approximate location of a plunge cut using various means. However, no prior art devices provide means for transporting and then securely mounting a portable plate joiner in the work vicinity so that workpieces may be accurately supported by the device and so that the user's hands may be free during the operation of the device. This is important because proper orientation of plunge cuts into workpieces depends greatly on the balance, support, and alignment of the workpiece with respect to the cutter.

What has been needed, therefore, has been a bench mountable joining machine having means for supporting and positioning a workpiece while making a slot-like plunge cut into a joint surface of the workpiece. What has been further needed is a bench mountable joining machine having support means to provide adjustable support for a workpiece and to allow the user's hands to be free from contact with either the joining machine or the workpiece during powered operation.

SUMMARY OF THE INVENTION

A machine is provided for locating plunge cuts in surfaces of workpieces. The machine includes machine means for supporting and positioning a workpiece while making a slot-like plunge cut into a joint surface of the workpiece, and base means comprising a base member for removably mounting the machine to a bench.

DETAILED DESCRIPTION OF THE PREFERRED EMBODIMENTS

Detailed preferred embodiments of the present invention are disclosed. It is to be understood, however, that the disclosed embodiments are merely exemplary of the invention, which may be embodied in various forms. Therefore, specific structural and functional details disclosed are not to be interpreted as limiting, but rather as a representative basis for teaching one skilled in the art to variously employ the present invention in virtually any appropriately detailed system or structure. It will be understood that in some circumstances relative material thicknesses and relative component sizes may be shown exaggerated to facilitate an understanding of the invention.

Figure 1:
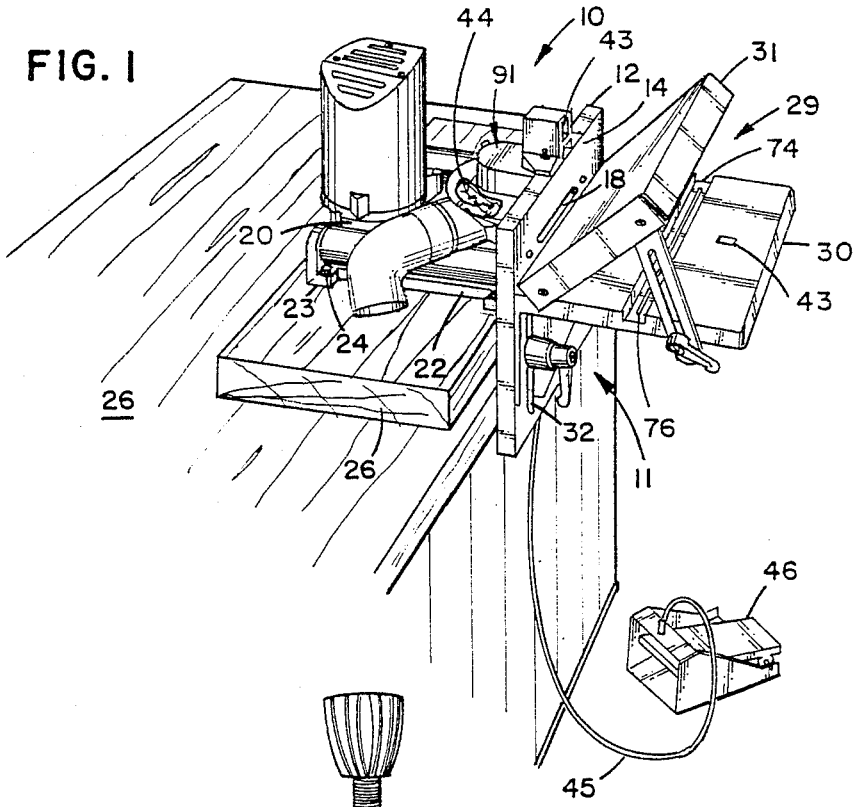
FIG. 1 is a perspective view of a portable bench-mountable joining machine with a control pedal mechanism and with adjustable table means oriented to provide angular relation of a workpiece surface to the cutter slot.

FIG. 1 illustrates a portable bench-mountable joining machine 10 comprising machine means for supporting and positioning a workpiece while making a slot-like plunge cut, a slot cut, or a rabbet cut into a joint surface of the workpiece. Bench-mountable joining machine 10 machine means comprises support means 11 including fence means 12 having a guide surface 14 for laterally supporting and positioning a workpiece requiring a plunge cut. Guide surface 14 comprises a cutter slot 18 through which a slotting cutter, which is normally concealed behind cutter slot 18, is selectively moved for contact with the workpiece. Bench-mountable joining machine 10 machine means also includes means for causing the cutter to protrude from guide surface 14 through cutter slot 18 to make a slot-like plunge cut into the workpiece. Base means, comprising a movable upper base member 20 and a stationary lower base member 22, is provided for removably mounting joining machine 10 to a bench, such as a workbench or other support-like stand. Base member 22 may include various means for removably mounting joining machine 10 to a workbench, such as representative mounting sections 23, which are constructed and arranged for cooperation with fastening means 24 to mount joining machine 10 to workbench 26 or other stand. Other means for mounting joining machine 10 include clamp means, expanding screw means, vice means, and the like.

As further illustrated in FIG. 1, support means 11 comprises adjustable table means 29 having a table member 30 for providing vertical support to a workpiece. Adjustable table means 29 may also comprise an optional angle table member 31 constructed and arranged for supporting a workpiece at an adjustable angle to fence means 12. Adjustable table means 29 is preferably constructed and arranged for selective movement relative to cutter slot 18 to provide means for adjustably locating the cut in variously sized workpieces. The movement is preferably accomplished by a selectively lockable tongue and groove type mechanism 32.

Figure 2:
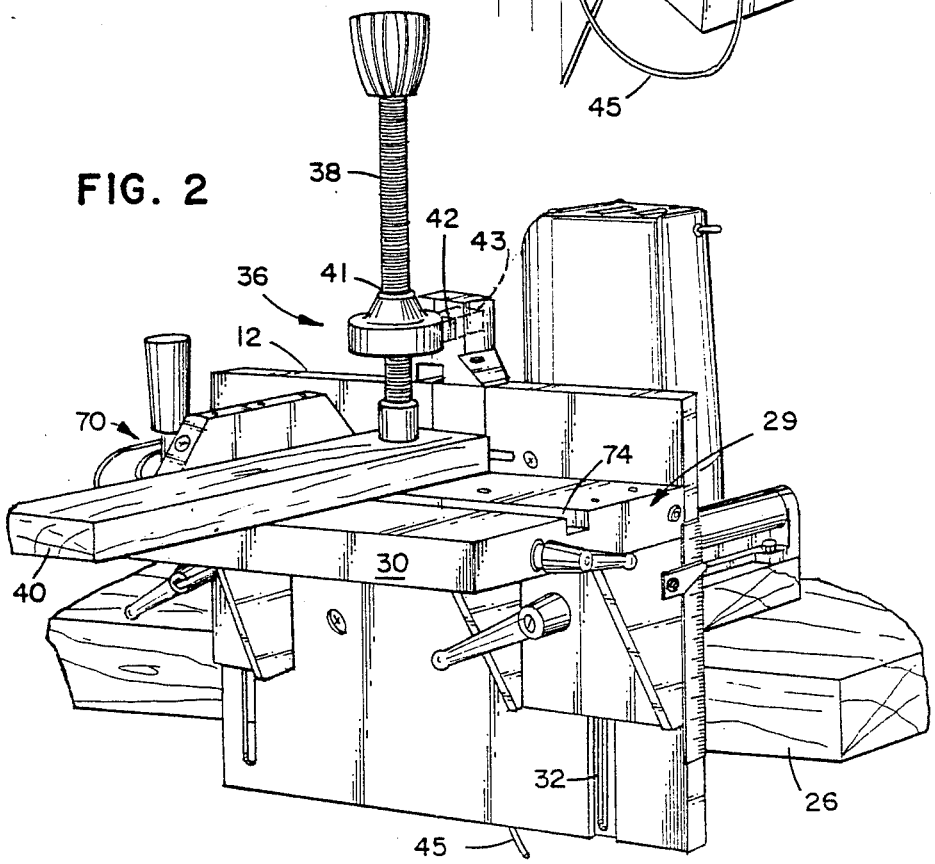
FIG. 2 is a perspective view of a portable bench-mountable joining machine shown with a manually operated clamp member for securely positioning the workpiece adjacent the cutter slot.

As illustrated in FIG. 2, optional clamp means 36 comprises a clamp member 38 for securing workpiece 40 against adjustable table means 29 and fence means 12. Clamp member 38 may comprise threads for adjusting clamp member 38 in relation to workpiece 40. Quick release means 41 may also be provided to rapidly release clamp member 38 from contact with workpiece 40 through use of cam-like release means. A user of bench-mountable joining machine 10 may prefer to maintain his hands free during operation of the device. Thus, clamp member 38 permits the user's hands to remain free of the workpiece during cutting operations. Clamp means 36 typically comprises mounting means for secure attachment to fence means 12 or to adjustable table means 29. Preferably, the mounting means comprises a clamp mounting peg 42 constructed and arranged for insertion into one of a plurality of clamp mounting holes 43. The precise shape and locations of peg 42 and holes 43 may vary as required.

Figure 3:
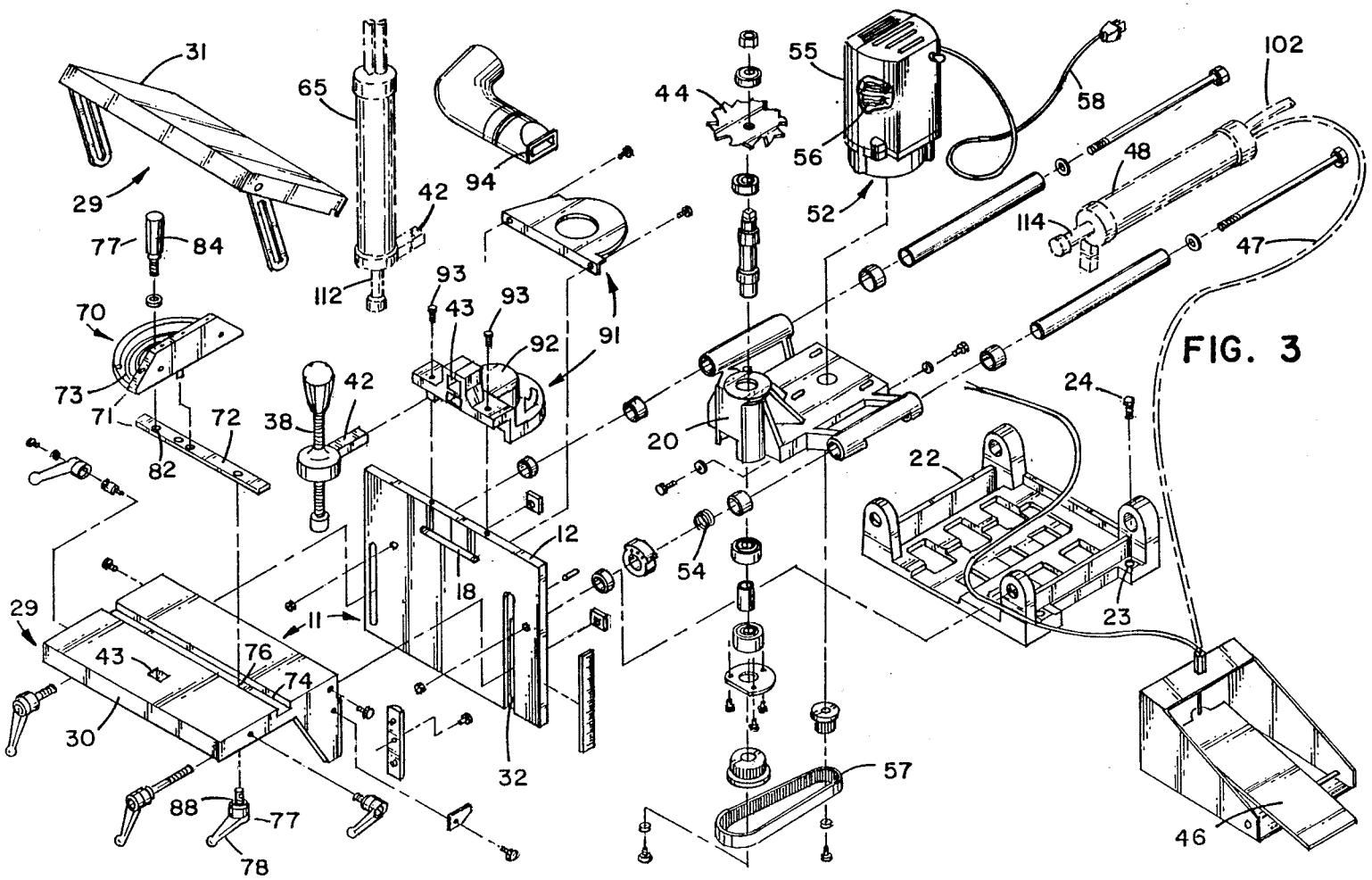
FIG. 3 is an exploded perspective view of a portable bench-mountable joining machine.
Figure 4:
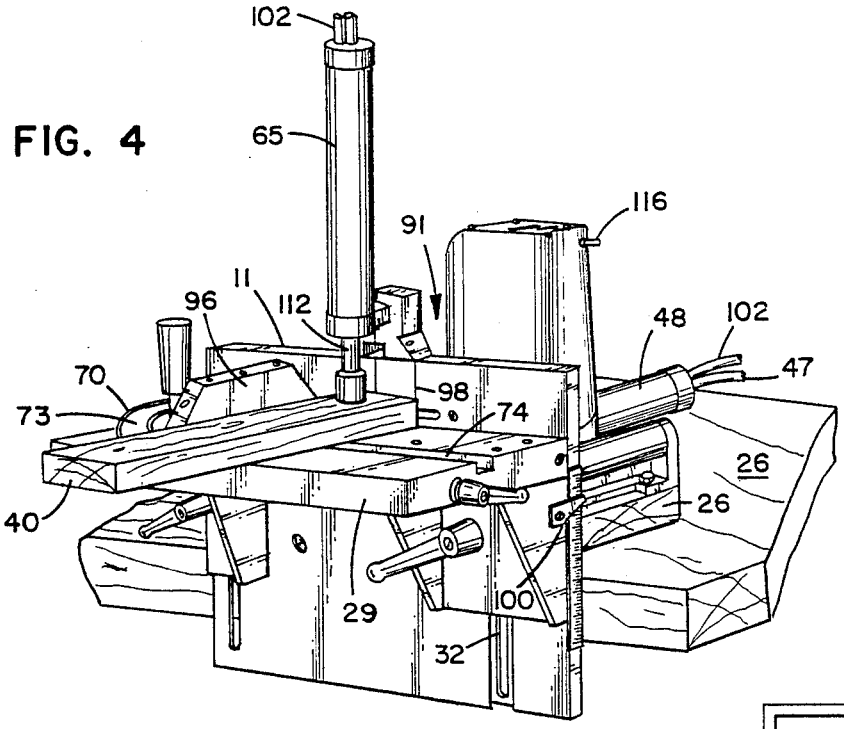
FIG. 4 is a perspective view of a portable bench-mountable joining machine shown with a pneumatically operated clamp member for securely positioning the workpiece adjacent the cutter slot and with a pneumatically operated plunge cutting means.
Figure 5:
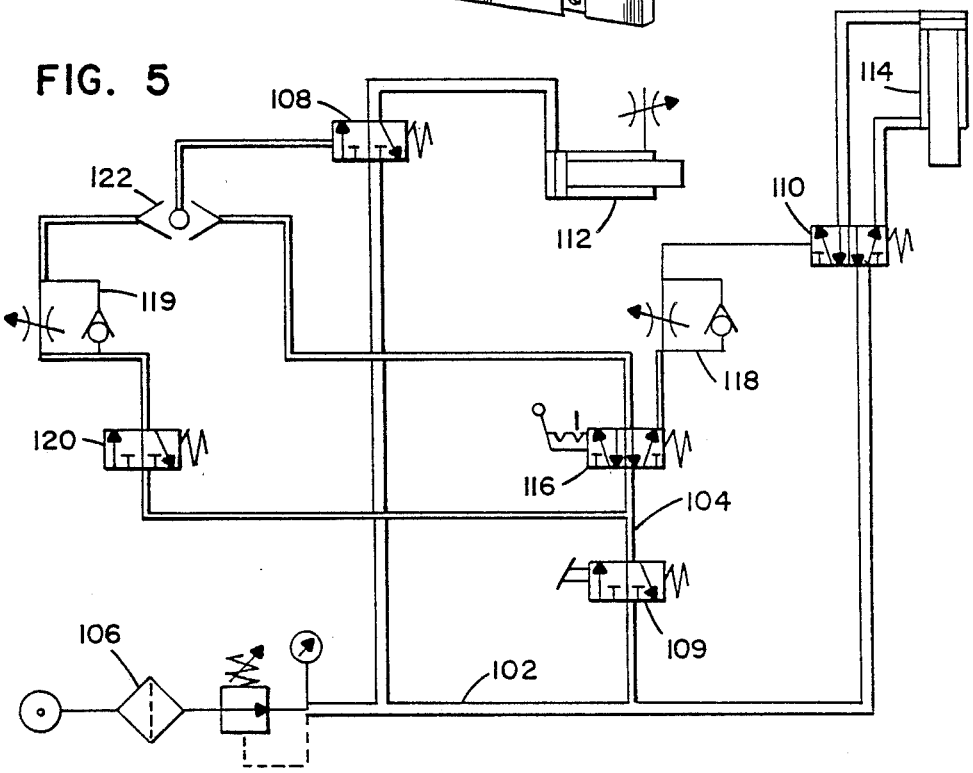
FIG. 5 is a schematic representation of a means for controlling and powering movement of a pneumatically operated clamp member and/or movement of a plunge cutting means toward and away from a workpiece.

A preferred bench-mountable machine 10 provides plunge-cutting means for moving the cutter 44 through cutter slot 18. Referring to FIGS. 1 and 2, such plungecutting means comprises a mechanical cable mechanism 45 comprising cabling which extends between a foot pedal actuator 46 and movable upper base member 20. Preferably, cable mechanism 45 operates like a conventional bicycle brake cable to mechanically bias movable upper base member 20 so that cutter 44 extends through cutter slot 18 when foot pedal actuator 46 is depressed. However, as illustrated in FIGS. 3 and 4, foot pedal actuator 46 may be alternately connected to electrical cabling 47 and pneumatic plunge cutting means 48. In the latter arrangement, control means 50, which is detailed in FIG. 5, is provided to control the plunge-cutting movement of the movable upper base member 20 and other portions of joining machine 10 as desired. Preferred control means 50 circuitry will be further detailed in discussion relating to FIG. 5 below.

As further illustrated in FIG. 3, movable upper base member 20 is constructed and arranged for cooperation with biasing spring means 54 so that cutter 44, which moves with upper base member 20, is selectively retracted from cutter slot 18 by release of foot pedal 46 and by the expansion force of biasing spring means 54 acting against upper base member 20. It is appreciated, however, that the plunge-cutting means of machine 10 comprises means for selectively holding cutter 44 in a position extending through cutter slot 18 so that an elongated slot may be cut into workpiece 40 by sliding workpiece 40 on table means 29 along guide surface 14.

FIG. 3 also illustrates motor housing 55 comprising motor means 56 for powering belt means 57 and cutter 44. Preferred motor means 56 comprises an electric motor having an electrical power cord 58.

As illustrated in FIGS. 3 and 4, a preferred embodiment of bench-mountable joining machine 10 includes pneumatic plunge-cutting means 48 comprising a pneumatically operated clamp member 65 for securing workpiece 40 against adjustable table means 29 and fence means 12. It is preferable that control means 50, depicted in FIG. 5, comprises means for securing clamp member 65 in contact with workpiece 40 prior to initiating cutter 44 movement through cutter slot 18. Pneumatically operated clamp member 65 also includes mounting means for secure attachment to fence means 12 or adjustable table means 29. Suitable mounting means comprise clamp mounting peg 42 and clamp mounting holes 43, best illustrated in FIGS. 1, 3, and 4.

A preferred embodiment of bench-mountable joining machine 10 comprises adjustable table means 29. Adjustable table means 29 comprises miter gauge means 70, shown in FIGS. 3 and 4, to facilitate accurate and secure positioning of a workpiece 40 in relation to cutter slot 18. Preferably, miter gauge means 70 comprises miter gauge 71 having a guide rail 72 and an angular positioning member 73. A preferred miter gauge means 70 further comprises a table groove 74 located in adjustable table means 29 along an axis which is preferably substantially parallel to guide surface 14 of fence means 12. Table groove 74 thus permits guiding travel of miter gauge guide rail 72 therein. Also, means for selectively locking miter gauge 71 into a fixed position is provided Miter gauge means 70 further comprises a slot 76 passing through table means 29 below table groove 74 which is constructed and arranged for receipt of locking means 77 locking member 78 therethrough. Locking member 78, which is preferably accessible from below adjustable table means 29, passes through slot 76 for selectively locking miter gauge 71 into a fixed position. Locking member 78 comprises a shoulder 88 for bearing against a bottom surface 89 of the table means in order to securely lock miter gauge 71 into a fixed position. Further, miter gauge guide rail 72 preferably comprises a threaded aperture 82 for receiving a threaded shaft 84. Locking means 77 thus comprises shaft 84 threaded into aperture 82 of miter gauge guide rail 72. It is appreciated that angle table member 31 of adjustable table means 29 may also comprise miter gauge means 70.

Referring to FIGS. 1, 3 and 4, a cutter protection system 91 is illustrated. Preferred cutter protection system 91 comprises blade guard means 92 mounted on support means 11 for preventing accidental contact with cutter 44 when the cutter is located behind cutter slot 18. As shown in FIG. 3, preferred blade guard means 92 is attached by screw means 93 to fence means 12. This construction permits ready removal of blade guard means 92 to facilitate replacement of cutter 44 as desired. Cutter protection system 91 also comprises a dust removal housing 94 which is preferably connected to blade guard means 92 for exhausting sawdust and other debris from cutter 44 and cutter slot 18 during machine operation. A hose means may be connected to dust removal housing 94 to route the debris to a collection container or the like. Cutter protection system 91 thus enhances the safety of operation of bench-mountable joining machine 10 as well as promoting a dust-free operating environment.

Referring to FIG. 4, a preferred embodiment bench-mountable joining machine 10 is illustrated attached to a workbench 26, with pneumatically operated clamp member 65 providing clamping contact with workpiece 40. As shown in FIG. 4, miter gauge means 70 comprises a selectively movable and lockable stock stop surface 96 to assist in maintaining workpiece 40 in precise position with cutter slot 18 during grooving or slotting operations. Other features of bench-mountable joining machine 10 which promote accuracy and ease of operation include workcentering means comprising centering line 98 for properly aligning workpiece 40 with cutter 44, and measurement scale means 100 for accurately positioning the spacing of adjustable table means 29 relative to the position of cutter 44.

While the exact structure of each particular component of control means 50 is not crucial to achieve the advantages of the present invention, a schematic illustration of a preferred control means 50 is provided in FIG. 5. As shown, control means 50 comprises supply air lines 102 and control lines 104. A pneumatic pressure source 106 is constructed and arranged to provide supply air through supply air lines 102 to valve means comprising valves 108, 109 and 110. Preferably, valve 108 comprises a three-way air piloted valve, while valve 109 comprises a foot-operated valve in cooperation with foot pedal actuator 46, and valve 110 preferably comprises a four-way ported air valve.

Preferred control means 50 is constructed and arranged so that when foot-operated valve 109 is actuated, control lines 104 then permit pneumatic pressure to actuate piston means 112. As illustrated in FIGS. 4 and 5, pneumatically operated clamp member 65 includes moveable piston means 112. Accordingly, actuation of foot pedal actuator 46 initiates clamping movement of piston means 112 extending from pneumatically operated clamp member 65 into contact with workpiece 40.

As depicted in FIG. 5, actuation of foot-operated valve 109 allows control lines 104 to operate valve 110. As further illustrated, valve 110 preferably provides means for actuating piston means 114 which allows selective movement of cutter 44 through cutter slot 18. Although various piston stroke lengths may be utilized, it is particularly important that, for certain cuts, piston means 112 and 114 be constructed and arranged so that workpiece 40 is first securely clamped before cutter 44 is moved through cutter slot 18 and into contact with workpiece 40. Accordingly, preferred control means 50 control lines 104 comprise toggle switch air valve 116, flow control valves 118, 119 for regulating piston speeds, or gate valve 122, and stroke-completion sensing means 120, all of which cooperate to selectively clamp workpiece 40 with piston means 112 prior to contact of cutter 44 with workpiece 40. However, both the clamping operation and the movement of cutter 44 toward and away from workpiece 40 may initiated by operation of foot pedal actuator 46, thereby allowing the user's hands to remain free of the cutting area.

The present invention thus provides a plate joining machine 10 which may be readily transported to a desired job location. However, means for securely mounting plate joining machine 10 to a bench, table, or other work surface is provided to enhance stability during grooving or slotting operation. Yet, bench mountable plate joining machine 10 also permits secure bracing of a workpiece on the machine. These features combine to provide a highly stable work platform which promotes maximum accuracy and ease of use.

It is to be understood that while certain embodiments of the present invention have been illustrated and described, the invention is not to be limited to the specific forms or arrangements of parts described and shown above, since others skilled in the art may devise other embodiments still within the limits of the claims.

What is claimed is:

1. A bench mountable joining machine comprising:
   (a) machine means comprising a blade-type slotting cutter for supporting and positioning a workpiece while making a slot-like plunge cut into a joint surface of the workpiece, the plunge cut having a variable depth which corresponds to the radius of the slotting cutter; and
   (b) base means comprising a base member for removably mounting the machine to a bench.

2. A machine according to claim 1 wherein the machine means comprises:
   (a) support means comprising:
      (i) adjustable table means having a table member for providing horizontal support to a workpiece; and
      (ii) bench means having a guide surface for laterally supporting and positioning a workpiece requiring the slot-like plunge cut, the guide surface comprising a cutter slot;
   (b) the slotting cutter being normally concealed behind the cutter slot; and
   (c) plunge-cutting means for causing the cutter to protrude from the guide surface through the cutter slot and to make the slot-like plunge cut into the workpiece.

3. The machine of claim 2 wherein the support means comprises:
   (a) clamp means for securing the workpiece against the adjustable table means and the fence means; and
   (b) quick release means for quickly releasing the clamp means from contact with the workpiece.

4. The machine of claim 3 wherein the clamp means comprises:
   (a) means for rapidly positioning the clamp means into contact with the workpiece; and
   (b) threads for tightening the clamp means onto the workpiece.

5. The machine of claim 3 wherein the clamp means comprises:
   (a) a movable clamp member for contacting the workpiece; and
   (b) means for mounting the clamp means to the adjustable table means.

6. The machine of claim 3 wherein the clamp means comprises:
   (a) a movable clamp member for contacting the workpiece; and
   (b) means for mounting the clamp means to the fence means.

7. The machine of claim 2 wherein the plunge-cutting means comprises:
   (a) mechanical cable means for mechanically moving the cutter through the cutter slot; and
   (b) control means connected to the mechanical cable means for controlling the movement of the cutter onto the workpiece.

8. The machine of claim 7 wherein the control means comprises a foot pedal.

9. The machine of claim 2 wherein the plunge-cutting means comprises means for selectively holding the cutter in a position extending through the cutter slot so that an elongated slot can be cut into the workpiece by sliding the workpiece on the adjustable table means along the guide surface.

10. The machine of claim 2 wherein the plunge-cutting means comprises:
(a) pneumatic means for pneumatically moving the cutter through the cutter slot; and
(b) means connected to the pneumatic means for controlling the movement of the cutter onto the workpiece.

11. The machine of claim 10 wherein:
(a) the pneumatic means comprises a pneumatically operated clamp member for securing the workpiece against the table means and the fence means; and
(b) the control means comprises means for securing the clamp member into contact with the workpiece before the cutter is moved through the cutter slot.

12. The machine of claim 10 wherein the control means comprises a foot pedal.

13. The machine of claim 2 wherein the adjustable table means comprises miter gauge means for facilitating accurate and stable positioning of a workpiece in relation to the cutter slot, the miter gauge means comprising:
(a) a miter gauge comprising a guide rail and an angular positioning member; and
(b) a table groove located in the table means along an axis substantially parallel to the fence means guide surface, the table groove guiding travel of the miter gauge guide rail.

14. The machine of claim 13 wherein the table means comprises means for selectively locking the miter gauge into a fixed position.

15. The machine of claim 14 wherein the table means comprises:
(a) a slot passing through the table means below the table groove; and
(b) locking means accessible from below the table means and passing through the slot for selectively locking the miter gauge into the fixed position.

16. The machine of claim 15 wherein:
(a) the miter gauge guide rail comprises a threaded aperture for receiving a threaded shaft; and
(b) the locking means comprises a shaft threaded into the aperture of the miter gauge guide rail, the locking means further comprising a shoulder for bearing against the bottom of the table means in order to selectively lock the miter gauge into the fixed position.

17. The machine of claim 2 wherein the support means comprises a cutter protection system including:
(a) blade guard means mounted on the support means for preventing accidental contact with the cutter when the cutter is located behind the cutter slot; and
(b) a dust removal housing connected to the blade guard means for exhausting sawdust and debris from the cutter and the cutter slot during machine operation.

18. The machine of claim 2 wherein the adjustable table means comprises an angle table member for supporting a workpiece at an adjustable angle to the fence means.

19. The machine of claim 2 wherein the support means comprises measurement scale means for accurately positioning the spacing of the table means relative to the position of the cutter.

20. A bench-mountable joining machine for supporting and positioning a workpiece while making a slot-like plunge cut into a joint surface of the workpiece, comprising:
(a) support means, comprising:
(i) adjustable table means having a table member for providing vertical support to a workpiece; and
(ii) fence means having a guide surface for laterally supporting and positioning a workpiece requiring a plunge cut, the guide surface comprising a cutter slot;
(b) a blade-type slotting cutter normally concealing behind the cutter slot;
(c) plunge-cutting means for causing the cutter to protrude from the guide surface through the cutter slot and to make a slot-like plunge cut into the workpiece, the plunge-cut having a variable depth which corresponds to the radius of the slotting cutter; and
(d) base means comprising a base member for removably mounting the machine to a bench, 21. The machine of claim 20 wherein the support means comprises:
(a) clamp means for securing the workpiece against the table means and the fence means; and
(b) quick release means for quickly releasing the clamp member from contact with the workpiece.

22. The machine of claim 20 wherein the plungecutting means comprises:
(a) mechanical cable means for mechanically moving the cutter through the cutter slot; and
(b) control means connected to the mechanical cable means for controlling the movement of the cutter onto the workpiece.

23. The machine of claim 22 wherein the control means comprises a foot pedal.

24. The machine of claim 20 wherein the plungecutting means comprises means for selectively holding the cutter in a position extending through the cutter slot so that an elongated slot can be cut into the workpiece by sliding the workpiece on the adjustable table means along the guide surface.

25. The machine of claim 20 wherein the plunge-cutting means comprises:
(a) pneumatic means for pneumatically moving the cutter through the cutter slot; and
(b) control means connected to the pneumatic means for controlling the movement of the cutter onto the workpiece.

26. The machine of claim 25 wherein:
(a) the pneumatic means comprises a pneumatically operated clamp member for securing the workpiece against the table means and the fence means; and
(b) the control means comprises means for securing the clamp member into contact with the workpiece before the cutter is moved through the cutter slot.

27. The machine of claim 20 wherein the adjustable table means comprises miter gauge means for facilitating accurate and stable positioning of a workpiece in relation to the cutter slot, the miter gauge means comprising:

(a) a miter gauge comprising a guide rail and an angular positioning member; and (b) a table groove located in the table means along an axis substantially parallel to the fence means guide surface, the table groove guiding travel of the miter gauge guide rail.

28. The machine of claim 27 wherein the table means comprises means for selectively locking the miter gauge into a fixed position.

29. The machine of claim 20 wherein the support means comprises a cutter protection system including:

(a) blade guard means mounted on the support means for preventing accidental contact with the cutter when the cutter is located behind the cutter slot; and (b) a dust removal housing connected to the blade guard means for exhausting sawdust and debris the cutter and the cutter slot during machine operation.

30. The machine of claim 20 wherein the adjustable table means comprises an angle table member for supporting a workpiece at an adjustable angle to the fence means.

31. A bench mountable joining machine for supporting and positioning a workpiece while making a plunge cut into a joint surface of the workpiece, comprising:

(a) adjustable table means having a table member for providing horizontal support to the workpiece;

(b) clamp means for providing clamping contact with the workpiece to securely position the workpiece;

(c) fence means having a guide surface for laterally supporting and positioning a workpiece requiring a plunge cut, the guide surface comprising a cutter slot;

(d) a blade-type slotting cutter normally concealed behind the cutter slot;

(e) cutter projection means comprising blade guard means for preventing accidental contact with the cutter when the cutter is located behind the cutter slot, the cutter protection means further comprising a dust removal housing for exhausting sawdust and debris from the cutter and the cutter slot during machine operation;

(f) plunge-cutting means for causing the cutter to protrude from the guide surface through the cutter slot and to make a slot-like plunge cut into the workpiece the plunge cut having a variable depth which corresponds to the radius of the slotting cutter; and (g) base means comprising a base member for removably mounting the machine to a bench.

* * * * *

UNITED STATES PATENT AND TRADEMARK OFFICE

CERTIFICATE OF CORRECTION

PATENT NO. : 4,934,422

DATED : June 19, 1990

INVENTOR(S) : Robert M. Hempy et al.

It is certified that error appears in the above-identified patent and that said Letters Patent is hereby corrected as shown below:

Col. 7, line 11, before "means connected" insert--control--.

Col. 9, line 17, after "debris" insert--from--.

Col. 10, line 11, "projection" should read--protection--.

Signed and Sealed this

Twenty-fifth Day of February, 1992

*Attest:*

HARRY F. MANBECK, JR.

*Attesting Officer*

*Commissioner of Patents and Trademarks*